US008786427B2

(12) United States Patent
Hsuan

(10) Patent No.: US 8,786,427 B2
(45) Date of Patent: Jul. 22, 2014

(54) PORTABLE INFORMATION DETECTION AND PROCESSING DEVICE AND SYSTEM

(75) Inventor: Min-Chih Hsuan, Hsinchu (TW)

(73) Assignee: Smile Technology Co., Ltd., Mahe' (SC)

( * ) Notice: Subject to any disclaimer, the term of this patent is extended or adjusted under 35 U.S.C. 154(b) by 95 days.

(21) Appl. No.: 13/431,413

(22) Filed: Mar. 27, 2012

(65) Prior Publication Data

US 2012/0249322 A1 Oct. 4, 2012

(30) Foreign Application Priority Data

Mar. 29, 2011 (TW) ..... 100110816 A

(51) Int. Cl.
*G08B 1/08* (2006.01)

(52) U.S. Cl.
USPC ..... 340/539.1; 340/506; 340/3.1; 340/539.13

(58) Field of Classification Search
USPC ..... 340/539.1, 539.11, 506, 3.1, 539.13
See application file for complete search history.

(56) References Cited

U.S. PATENT DOCUMENTS 5,400,246 A * 3/1995 Wilson et al. ..... 700/17
5,959,529 A * 9/1999 Kail, IV ..... 340/539.12

* cited by examiner

*Primary Examiner* — Daryl Pope
(74) *Attorney, Agent, or Firm* — Muncy, Geissler, Olds & Lowe, P.C.

(57) ABSTRACT

A portable information detection and processing device includes an information detection unit, for detecting information recorded by at least one functional element; a memory unit, for recording recognition data of the at least one functional element and information detected by the functional element; a display unit, for displaying the recognition data of the functional element and the information recorded by the functional element; and an information processing unit, connected to the information detection unit, the memory unit and the display unit, for processing the recognition data of the functional element and the information detected by the functional element, and controlling the information detection unit, the memory unit and the display unit.

28 Claims, 3 Drawing Sheets

PORTABLE INFORMATION DETECTION AND PROCESSING DEVICE AND SYSTEM

CROSS-REFERENCE TO RELATED APPLICATIONS

This non-provisional application claims priority under 35 U.S.C. §119(a) on Patent Application No(s). 100110816 filed in Taiwan, R.O.C. on Mar. 29, 2011, the entire contents of which are hereby incorporated by reference.

BACKGROUND

1. Technical Field

The disclosure relates to an information detection system, and more particularly to a portable information detection and processing system, with a detector and an information detection and processing device applicable in the system.

2. Related Art

It has become a very common application to use a wired or wireless detection device to detect various physical, chemical or biological information and its changes, and analyze possible outcomes or effects through a specific analytical circuit or software. The most common detection system is a system including a single or multiple functional elements with detection and/or recognition function placed or built at multiple positions, the system periodically or occasionally reads signals detected or recorded by the functional elements, and the system provides the detected or recorded signals for a specific processing device to analyze and determine the detected or recorded signals.

For example, in hospitals or clinics, multiple physiological detectors such as detectors for measuring heart beat, blood pressure and body temperature are placed or fitted on a patient, and the detectors are connected to a processing device which displays and records measurement results. The recorded measurement results may be digital or analog. For example, the recorded digital measurement results can be transmitted to other computer apparatuses for performing other processing. Furthermore, in a vehicle such as a car or truck, detectors with various detection functions are installed at multiple positions of the vehicle body and connected to a processing device to monitor the surrounding to assure the safety of the vehicle.

In the above-mentioned systems, the functional elements and the processing device are connected in a wired manner. Besides transmitting detection signals, the wired connection is also used for supplying power to the functional elements. Because a physical connection is required in this application mode, the wiring is complicated, and the valid use distance of the functional elements is also limited.

Besides the wired connection, the information recorded by the functional elements may also be read in a wireless manner. For example, an identity (ID) recognition chip implanted in an animal body has a specific code for recognition of the ID of the animal. Additionally, recognition chips are attached on commodities in places where a large quantity of various commodities need to be managed such as shopping malls or warehouses. Codes carried in this type of the recognition chips may be read by a read device, so that the system may control and record the commodities entering or leaving the places.

In this application scenario, although it is unnecessary to connect the functional elements to the processing device, the read device must be equipped, and the read device is connected to or linked to the processing device. If there is no read device, the functional elements such as the recognition chips or the detectors become useless. As a result, a user can only visually check the commodities and make the record manually, which is very inconvenient. Additionally, the read device has made with high cost and has a large volume, and cannot be operated unless being connected to a processing device.

Furthermore, in many application scenarios, the functional elements such as the detectors and the recognition chips are installed at places that cannot be found by human eyes, for example, inside the human body, animal body or an article, and signals detected or recorded by the functional elements can only be obtained by the read device. Furthermore, an operator needs to remember the positions of the functional elements, so that the operator may correctly read required contents, which is also inconvenient in application.

Therefore, it is in need of a novel information detection and processing device, which is capable of detecting signals detected or recorded by multiple functional elements and converting the signals into useful information.

Meanwhile, it is in need of a portable information detection and processing device, which is capable of converting information detected or recorded by functional elements into useful information without using an additional read device.

Furthermore, it is also in need of a portable information detection and processing device, which supports the operations of multiple functional elements without physical connection.

Furthermore, it is also in need of a portable information detection and processing system, which supports multiple functional elements and provides information detection function.

SUMMARY

Accordingly, the disclosure discloses an information detection and processing device, which is capable of detecting signals detected or recorded by multiple functional elements and converting the signals into useful information.

The disclosure further discloses a portable information detection and processing device, which is capable of converting information detected or recorded by functional elements into useful information without additional read device.

The disclosure discloses a portable information detection and processing device, which supports operation of multiple functional elements without physical connection.

The disclosure discloses a portable information detection and processing system, which supports multiple functional elements and has an information detection function.

The portable information detection and processing device according to the disclosure is used for detecting information detected or recorded by multiple functional elements in a specific space, converting the information into useful data, and displaying the data in a human-sensible form or in a digital form. The portable information detection and processing device includes:

- an information detection unit, for detecting the information recorded by the at least one functional element;
- a memory unit, for recording recognition data of the functional element and the information detected by the functional element;
- a display unit, for displaying the recognition data of the functional element and the information recorded by the functional element; and
- an information processing unit, connected to the information detection unit, the memory unit and the display unit, for processing the recognition data of the functional element and the information detected by the functional element, and controlling the information detection unit, the memory unit and the display unit.

In an embodiment of the disclosure, the information detection unit may transmit a wake-up signal to the at least one functional element to activate the functional element. In some embodiments of the disclosure, the information processing unit is configured to control the information detection unit to periodically transmit the wake-up signal to the functional element. In other embodiments, the information processing unit is configured to control the information detection unit to transmit the wake-up signal to the functional element in a certain order.

In some embodiments of the disclosure, the information processing unit is configured to control the information detection unit to periodically detect the information recorded by the at least one functional element. In other embodiments, the information processing unit is configured to control the information detection unit to detect the information recorded by the at least one functional element in a certain order.

In some embodiments of the disclosure, the information processing unit is configured to control the display unit to periodically display the information. In other embodiments, the information processing unit is configured to control the display unit to display the information in a certain order.

In an embodiment of the disclosure, the portable information detection and processing device further includes a switch unit, for generating a wake-up signal in response to an external switch action to activate the information processing unit, and then activate the information detection unit and/or the display unit. The switch unit may be a manual switch, a photoelectric switch or a sensor switch.

In an embodiment of the disclosure, the information processing unit may perform operation on a value of the recorded information detected by the functional element to generate an operation result, and when the operation result exceeds a threshold, the information processing unit generates an activation signal to activate the display unit to display the result on the display unit. In other embodiments, the information processing unit generates the activation signal when receiving the wake-up signal.

In another embodiment of the disclosure, the portable information detection and processing device further includes an alarm device, in which the information processing unit generates the activation signal to activate the alarm device when the value of the operation result of the recorded information detected by the functional element exceeds the threshold. In these embodiments, the alarm device may be a buzzer, an alarm lamp or a loudspeaker, and the alarm device is driven by a drive device to send out alarm a sound or light.

The portable information detection and processing device of the disclosure may also include a communication unit, for transmitting specific information to an external machine in response to the activation signal. The specific information includes the recognition data of the functional element and the recorded information detected by the functional element. In this application embodiment, the information processing unit may perform operation on the value of the detection signal to generate an operation result, generate the activation signal when the operation result exceeds the threshold, and transmit the operation result to the external machine through the communication unit. In other embodiments, the information processing unit generates the activation signal when receiving the wake-up signal.

The memory unit of the portable information detection and processing device of the disclosure may be used for recording a code of the functional element, the information detected by the functional element, and a detection time. In this embodiment, the information processing unit may activate the communication unit when receiving the wake-up signal so that the communication unit transmits information stored by the memory unit to the external machine.

In application, the functional element may be a detector, including a pressure sensor, a gravity sensor, a sound sensor, an optical sensor, a humidity sensor, a temperature sensor, a displacement sensor, a shock sensor, a gas sensor, a chemical sensor and a satellite localizer. The functional element may merely be an ID recognition chip. In an embodiment of the disclosure, the information detection unit detects the recorded information of the functional element in a wireless manner such as through infrared ray, microwave, and radio, and performs data exchange with the functional element. A communication channel between the information detection unit and the functional element may include at least one interface selected from an RFID interface, a ZigBee interface, a WiFi interface, a Bluetooth interface, an HAVi interface, an IEEE 802.11 interface, an IEEE802.15 interface, an IEEE1394 interface, a Jini interface, a Salutation interface, an UPnP architecture interface, an X10 interface, a HomePlug interface and a HomePNA interface. In these embodiments, the functional element is equipped with a corresponding wireless communication network to perform data exchange with the information detection unit.

In an embodiment of the detection in a wireless communication manner, the wake-up signal transmitted by the information detection unit has specific power, and the functional element is equipped with a mechanism for receiving the specific power and converting the specific power into a working voltage. In this embodiment, the functional element may be further equipped with a rechargeable secondary battery for storing electric energy.

In other embodiments of the disclosure, the information detection unit is connected to the functional element in a wired manner such as through a wire, a cable, a flat cable and a signal line, to perform data exchange. In these embodiments, the communication channel between the information detection unit and the functional element may be a USB interface, a UART interface, an IIC bus and a line telephone interface. In these embodiments, the functional element is equipped with a mechanism for converting a voltage on the communication channel into a working voltage.

The portable information detection and processing device of the disclosure may further include a timer, for generating a time signal, and the display unit may display the time signal on a display.

The functional element applicable in the portable information detection and processing device of the disclosure may include a power supply unit, for managing power required by the functional element. In some embodiments of the disclosure, the power supply unit includes a secondary battery, for storing the power required by the detector. In other embodiments, the power supply unit includes a converter, for converting external power into the power required by the functional element. The external power may include power transmitted by a wire or power supplied by an external wireless energy source. The wireless energy source may include an inductive energy source. In this case, the power supply unit may include an inductive power generator.

The portable information detection and processing system of the disclosure includes the single portable information detection and processing device and the at least one functional element above mentioned. The portable information detection and processing device may detect the information recorded by the functional element and display the information on the display unit.

In an embodiment of the disclosure, the portable information detection and processing device displays the recorded information obtained in detection on the display unit when a specific condition is satisfied. In another embodiment, the portable information detection and processing device displays the recorded information obtained in detection on the display unit when receiving an external wake-up signal.

In an embodiment of the disclosure, the portable information detection and processing device includes a communication unit for transmitting the recorded information obtained in detection when the specific condition is satisfied. In another embodiment, the portable information detection and processing device transmits the recorded information obtained in detection through the communication unit when receiving the external wake-up signal.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The above and other objectives and advantages of the disclosure are more clearly illustrated through the detailed description below and with reference to the accompanying drawings.

Figure 1:
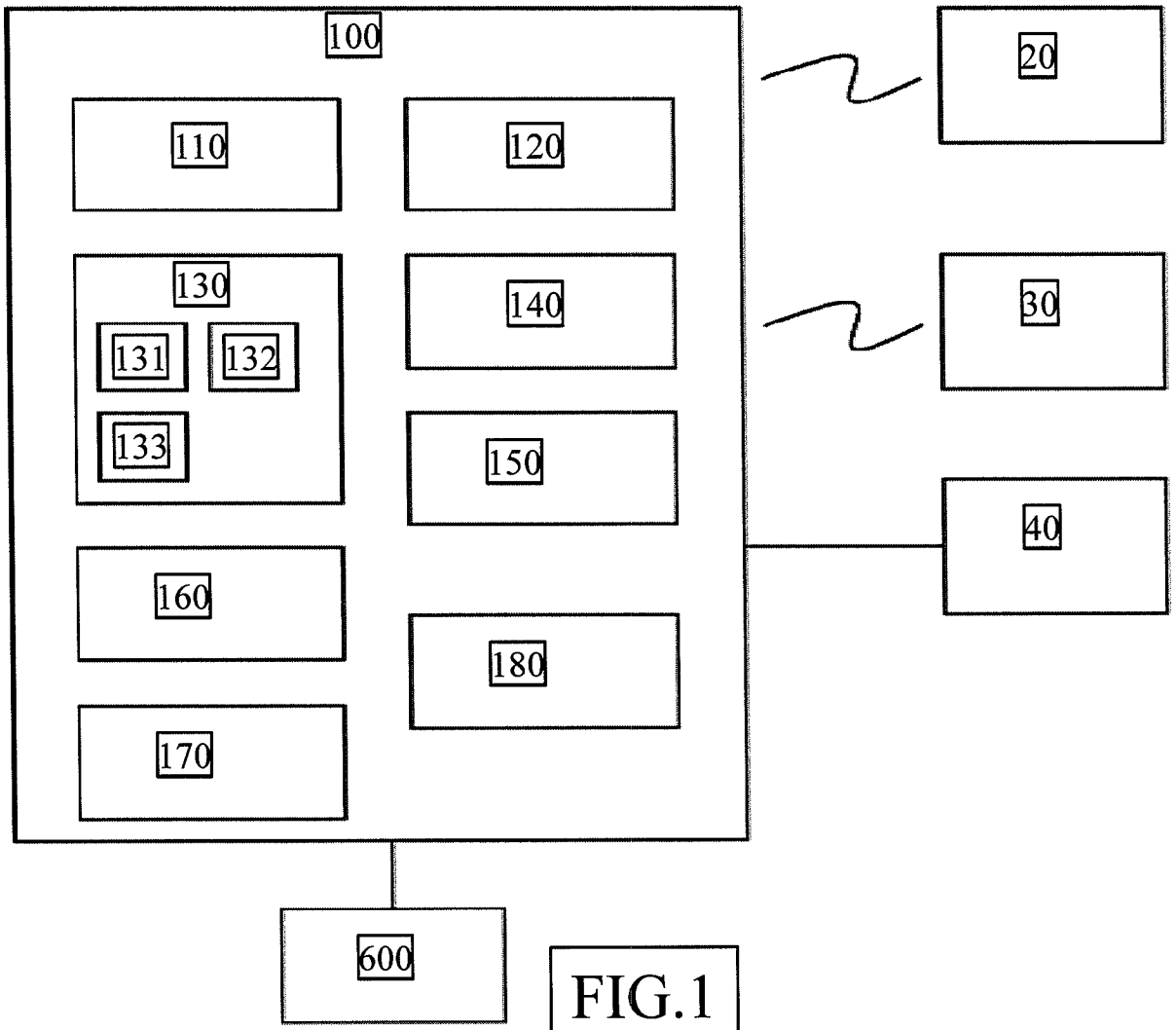
FIG. 1 is a systematic view of a portable information detection and processing system of the disclosure.

Hereinafter, the detailed architecture, components and application of the disclosure and embodiments thereof are described. FIG. 1 is a systematic view of a portable information detection and processing system of the disclosure. As shown in FIG. 1, the portable information detection and processing system 500 of the disclosure mainly includes an information detection and processing device 100 and functional elements 20, 30, 40. The functional elements 20, 30 or 40 may include a detector or a recognition chip. For example, the functional element 20 may be a recognition chip such as a radio-frequency identification (RFID) chip having wireless communication capability. Moreover, for example, the functional elements 30, 40 may be a detector chip such as a physiological detector, an environment detector, a physical detector, and an electrochemical detector. The functional elements 30, 40 may also be a working chip such as a mini drug injector, a control chip and a mini camera. When the functional element 20, 30, 40 is a detector chip or a working chip, the ID recognition function may be integrated in the functional element 20, 30 or 40. When the functional elements 20, 30, 40 are working chips, the detection function may further be integrated in the functional elements 20, 30, 40. The above-mentioned configurations are well known to persons of ordinary skill in the art.

The functional elements applicable in the portable information detection and processing system of the disclosure may include various detectors such as a pressure sensor, a gravity sensor, a sound sensor, an optical sensor, a humidity sensor, a temperature sensor, a displacement sensor, a shock sensor, a gas sensor, a chemical sensor and a satellite localizer. Detector elements having other functions and in other forms are also applicable in the disclosure.

The number of the functional elements is not limited, for example, may be one, hundreds or thousands, depending on the use and the operation and processing capability of the system.

In an embodiment of the disclosure, the information detection unit 100 detects the recorded information of the functional elements 20, 30, 40 in a wireless manner such as through infrared ray, microwave, and radio, and performs data exchange with the functional elements 20, 30, 40. The used communication channel may comprise at least one interface selected from an RFID interface, a ZigBee interface, a WiFi interface, a Bluetooth interface, an HAVi interface, an IEEE 802.11 interface, an IEEE802.15 interface, an IEEE1394 interface, a Jini interface, a Salutation interface, an UPnP architecture interface, an X10 interface, a HomePlug interface and a HomePNA interface. Other public or non-public communication interfaces may also be used in the disclosure. In one embodiment of the disclosure, the functional elements 20, 30, 40 are equipped with corresponding wireless communication lines to perform data exchange with the information detection unit.

In other embodiments of the disclosure, the information detection unit is connected to the functional element in a wired manner such as through a wire, a cable, a flat cable and a signal line to perform data exchange. In these embodiments, the used communication channel may be a USB interface, a UART interface, an IIC bus and a line telephone interface.

FIG. 1 also shows functional blocks of the portable information detection and processing device 100 of the disclosure. As shown in FIG. 1, the portable information detection and processing device 100 includes the information detection unit 110, for detecting information recorded by the functional elements 20, 30, 40; a memory unit 120, for recording recognition data of the functional elements 20, 30, 40 and information detected by the functional elements 20, 30, 40; a display unit 150, for displaying the recognition data of the functional elements 20, 30, 40 and the information recorded by the functional elements 20, 30, 40; and an information processing unit 130, connected to the information detection unit 110, the memory unit 120 and the display unit 150, for processing the recognition data of the functional elements 20, 30, 40 and the information detected by the functional elements 20, 30, 40, and controlling the information detection unit 110, the memory unit 120 and the display unit 150.

In an embodiment of the disclosure, the information detection unit 110 may transmit a wake-up signal to the functional elements 20, 30, 40 to activate the functional elements 20, 30, 40, respectively. In some embodiments of the disclosure, the information processing unit 130 is configured to control the information detection unit 110 to periodically transmit the wake-up signal to the functional elements 20, 30, 40. In other embodiments, the information processing unit 130 is configured to control the information detection unit 110 to transmit the wake-up signal to the functional elements 20, 30, 40 in a certain order.

In some embodiments of the disclosure, the information processing unit 130 is configured to control the information detection unit 110 to periodically detect the information recorded by the at least one functional elements 20, 30, 40. In other embodiments, the information processing unit 130 is configured to control the information detection unit 110 to detect the information recorded by the at least one functional elements 20, 30, 40 in a certain order.

In the above-mentioned functional blocks, the information detection unit 110 may be any commercially available wired receiving unit and/or wireless receiving unit, as the receiving unit can receive the information recorded by the functional elements 20, 30, 40. For example, the information detection unit 110 is connected to the functional elements 20, 30, 40 in a wired manner such as through a wire, a cable, a flat cable or a signal line, or in a wireless manner such as through infrared ray, microwave, and radio. As shown in the figure, the portable information detection and processing device 100 is connected to the functional elements 20, 30 in a wireless communication manner, and is connected to the functional element 40 in the wired manner. The communication protocol between the portable information detection and processing device 100 and the unction element 20, 30 or 40 may be any conventional communication standard, and may also be a protocol that is specially set. The communication protocol for different types of detectors or different detectors may be the same or different.

In an embodiment of the disclosure, the functional elements 20, 30, 40 are not equipped with an independent power supply, but the functional elements 20, 30, 40 are powered by the portable information detection and processing device 100. In such embodiments, the connection of the portable information detection and processing device 100 is implemented by using a cable through a common communication interface such as a USB interface. In this way, besides data exchange, the portable information detection and processing device 100 can also supply the power required by the functional elements 20, 30, 40. However, if the distance between the functional elements 20, 30, 40 and the portable information detection and processing device 100 is long, or the number of the functional elements 20, 30, 40 is large, the connection may also be implemented through a common wireless communication interface such as an RFID interface. However, if the portable information detection and processing device 100 needs to supply power, the portable information detection and processing device 100 can be an inductive power supply through electromagnetic waves. The power conversion mechanism having the above-mentioned function is conventional in the industry, and can be achieved by adopting commercially available products or elements.

Particularly, in an embodiment of detection in the wireless communication manner, the wake-up signal transmitted by the information detection unit 110 has specific power, and the functional elements 20, 30, 40 are equipped with a mechanism for receiving the power and converting the power into a working voltage. In this embodiment, the functional elements 20, 30, 40 may be equipped with a rechargeable secondary battery (not shown) for storing the electric energy. Otherwise, in an embodiment of connection in a wired manner, the functional elements 20, 30, 40 are equipped with a mechanism for converting a voltage on the connection into the working voltage. The mechanisms are also disclosed in the prior art, and are not described again herein.

The memory unit 120 may be various commercially available memory elements, for example, a volatile memory or a non-volatile memory, and is used for recording required information. Besides codes of the functional elements 20, 30, 40, formats of the recorded information, signal formats and values of the recorded information, the information may further include a position code and a function code of the functional elements 20, 30, 40 to provide complete information. The memory unit 120 may be further used for recording an applicable analysis program and the analysis program is used for providing operation and inference rules required by the information processing unit 130 for analyzing the recorded information. The memory unit 120 may further include a memory management firmware circuit (not shown), and the memory management firmware is used for managing reading, writing and erasing of data of the memory. The memory unit 120 having the function described above may also be a commercially available product.

The display unit 150 may be any commercially available digital or analog display element. Examples of the applicable digital display unit include a display panel, for example, a liquid crystal display (LCD), a plasma display and a light-emitting diode (LED) display; a projector, for example, an optical projector and a holographic projector; and a non-image display element, for example, a loudspeaker, an alarm and a buzzer. The display element is used for displaying the recorded information detected by the functional elements 20, 30, 40. In terms of limiting the volume of the portable information detection and processing device 100 and reduce the power consumption and the cost, the display element is optimally a small-area LCD. However, there is no any technical limitation to this kind of requirement.

The analog display unit may include any device for displaying text, numerals and/or patterns, for example, a plotter. The analog display unit can display the information recorded by the functional element and detected by the portable information detection and processing device in text, numerals and/or patterns.

The information processing unit 130 is a core unit of the portable information detection and processing device 100, and is used for analyzing, determining and displaying the recorded information of the functional elements 20, 30, 40. The information processing unit 130 is connected to the information detection unit 110, the memory unit 120 and the display unit 150 so that the information processing unit 130 controls the information detection unit 110, the memory unit 120 and the display unit 150. The information processing unit 130 may generally include a microprocessor core 131 and a corresponding processing circuit 132. The information processing unit 130 may store a part of information of the operation and inference rules for analysis and determination in the memory unit 120, and may also perform analysis, calculation and inference on the detection signal by adopting a hardware circuit in cooperation with stored data in an internal memory 133. The microprocessor core 131 may be a common device that is commercially available supported by a conventional circuit and software technology. The applicable microprocessor includes an Intel 8051 processor architecture, an ARM processor architecture and an Andes processor architecture.

In some embodiments of the disclosure, the information processing unit 100 is configured to control the display unit 150 to periodically display the information. In other embodiments, the information processing unit 110 is configured to control the display unit 150 to display the information in a certain order. The setting and implementation are achieved by using the conventional art.

As shown in the figure, the portable information detection and processing device may further include a switch unit 160, for generating a wake-up signal in response to an external switch action to activate the information processing unit 100 to activate the information detection unit 110 and/or the display unit 150. The switch unit 160 may be a manual switch, a photoelectric switch or a sensor switch. The switch unit 160 may also be any commercially available element. However, in an embodiment of the disclosure, the switch unit 160 is a capacitive sensor switch, because the area of the switch can be reduced and the switch can be easily fabricated by adopting a common CMOS process.

In an embodiment of the disclosure, the information processing unit 110 may perform operation on the recorded information detected by the functional elements 20, 30, 40 to generate an operation result, and when the operation result exceeds a threshold, the information processing unit 110 generates an activation signal to activate the display unit 150 to display the operation result on the display unit 150. In other embodiments, the information processing unit 110 generates the activation signal when receiving the wake-up signal.

As shown in FIG. 1, the portable information detection and processing device of the disclosure may further include an alarm device 170. The alarm device 170 may be a buzzer, an alarm lamp or a loudspeaker, and is driven by a drive device (not shown) to send out alarm sound or light. In these embodiments, the information processing unit 110 may generate the activation signal to activate the alarm device 170 when the value of the operation result of the recorded information obtained in detection exceeds the threshold.

As shown in the figure, the portable information detection and processing device of the disclosure may further include a communication unit 140, for transmitting a signal to an external machine 600 in response to the activation signal. The transmitted signal may include the recognition data of the functional elements 20, 30, 40 and the recorded information detected by the functional elements 20, 30, 40. In this type of application embodiments, the information processing unit 110 may perform operation on a value of a received detection signal to generate an operation result, generate the activation signal when the operation result exceeds the threshold, and transmits the operation result to the external machine 600 through the communication unit 140. In other embodiments, the information processing unit 110 generates the activation signal when receiving the wake-up signal.

The memory unit 120 of the portable information detection and processing device 100 of the disclosure may be used for recording the code of the functional elements 20, 30, 40, the information detected by the functional element 20, 30, 40, and detection time. In this embodiment, the information processing unit 110 may activate the communication unit 140 when receiving the wake-up signal to transmit information stored in the memory unit 120 to the external machine 600. Generally, the wake-up signal is transmitted by the external machine 600, and received and transmitted to the information processing unit 110 for processing by the communication unit 140. The wake-up mechanism may be implemented by using various prior arts, which is comprehensible to persons of ordinary skill in the art.

The external machine 600 is generally an input device, for example, a handheld read device, and can read specific information or data in the memory unit 120 of the portable information detection and processing device 100 through a conventional or specific communication protocol, and record the specific information or data in or transmit it to a computer apparatus (not shown) for further processing. The communication between the external machine 600 and the portable information detection and processing device 100 is implemented in the wireless manner, which, however, may also be implemented in the wired manner. The two manners are both well known in the industry, and are not described again herein.

As shown in FIG. 1, the portable information detection and processing device of the disclosure may further include a timer 180, for generating a time signal, in which the display unit 150 may display the time signal on a display to indicate generation time of the recorded information. If the information recorded by the memory unit 120 includes position codes of the functional elements 20, 30, 40 and signal type codes of the information detected by the functional elements 20, 30, 40, the information processing unit 130 may add the relevant position codes and the signal type codes of the functional elements 20, 30, 40 into the information obtained though detection. If the information recorded by the memory unit 120 includes the position codes of the functional element 20, 30, 40 and the signal type codes of the detection signal, the memory unit 120, the external machine 600 or other processing devices may store a lookup table for recording the position information of the functional elements 20, 30, 40 and the signal type information for determination.

Figure 2:
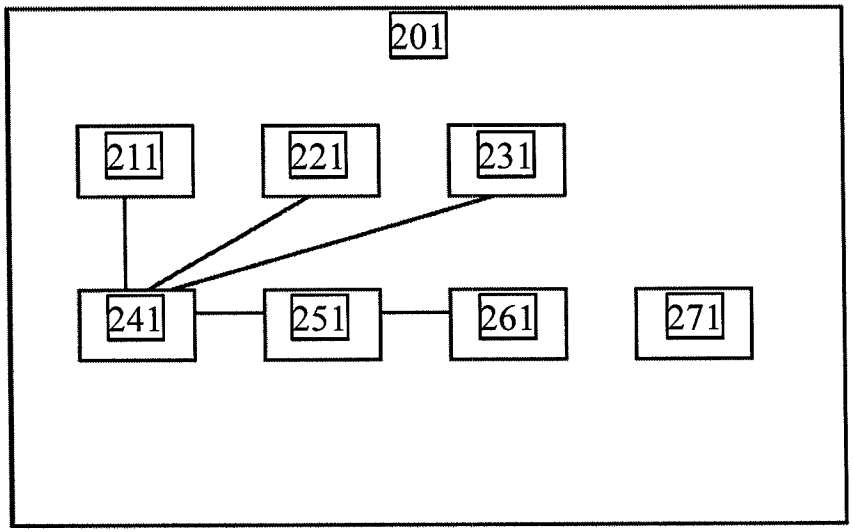
FIG. 2 is a general block diagram of a functional element applicable in the portable information detection and processing device of the disclosure.

FIG. 2 is a general block diagram of the functional elements 20, 30, 40 applicable in the portable information detection and processing device of the disclosure. As shown in FIG. 2, the functional element is a detector chip, especially a door and window shock detector. However, other detectors should have the same or similar architecture. As described above, the detector applicable in the portable information detection and processing system of the disclosure may be any detection device for detecting various physical, chemical or biological information and changes thereof. The detector may be a pressure sensor, a gravity sensor, a sound sensor, an optical sensor, a humidity sensor, a temperature sensor, a displacement sensor, a shock sensor, a gas sensor, a chemical sensor and a satellite localizer.

As shown in FIG. 2, the detector 200 includes a detection unit 211, for generating a detection signal in response to a property of a detection target or changes in the property, where in the embodiment shown in the figure, the detection unit 211 is a displacement detector attached on a window for sensing movement of the window; a memory unit 221, for recording a code of a detector 201 and format information of the detection signal; a communication unit 231, for establishing a signal connection with the information detection and processing device 100; a power supply unit 241, for converting and managing power required by the detector chip 200; and a processing device 251, connected to the detection unit 211, the memory unit 221, the communication unit 231 and the power supply unit 241, for transmitting the detection signal of the detection unit 211 and a detector code of the memory unit 221 to the portable information detection and processing device 100 through the communication unit 231.

In the detector chip 200 serving as the above-mentioned functional element, the detection unit 211 (displacement sensor) and the relevant circuits and micro mechanical structures such as the processing device 251, the memory unit 221, the communication unit 231 and the power supply unit 241 may be formed on a single chip. The detection unit 211 may be fabricated by using a micro-machine formed on the chip. In addition, the pressure sensor, the gravity sensor, the sound sensor, the optical sensor, the humidity sensor, the temperature sensor, the shock sensor, the gas sensor, the chemical sensor and the satellite localizer may also be fabricated in the same or similar manner. The processing device 251 may be formed by the commercially available microprocessor core above mentioned supported by a corresponding circuit and memory. The memory unit 221 may be the commercially available, e.g., the volatile memory or the non-volatile memory. The communication unit 231 may be implemented by a commercially available wireless micro-transceiver supported by a corresponding circuit, or may be implemented by a wired communication line. The power supply unit 241 may be any circuit for converting the power transmitted through the wire or the signal line or the inductive energy transmitted in the wireless manner into a suitable working voltage. All the circuits including the processing device 251, the memory unit 221, the communication unit 231 and the power supply unit 241 may be formed as the integrated circuits (ICs) on the same chip as the detection unit 211. Definitely, all or some of the processing device 241, the memory unit 221, the communication unit 231, the power supply unit 241 and the detection unit 211 may be fabricated by adopting individual IC chips respectively.

The communication protocol between the communication unit 231 and the information detection unit 110 may be any public communication standard, and may also be a protocol that is specifically set. The communication protocol for different types of the detectors or the different detectors may be the same or different. In an embodiment of the disclosure, the signal transmitted by the functional element includes a function code and a format description of the signal, a code of the functional element and a value of the recorded information. In other embodiments, the signal transmitted by the functional element may also include a position description of the functional element and other useful information, for example, the generation time of the recorded information. In practical application, the connection of the communication unit 231 and the information detection unit 110 is connected by using a cable through a commonly used communication interface such as the USB interface. Besides data exchange, the portable information detection and processing device 100 can also supply the power required by the functional elements 20, 30, 40. In addition, the connection may also be implemented in the wireless manner, for example, through the RFID interface. However, if the portable information detection and processing device 100 needs to supply the power, the portable information detection and processing device 100 can supply an inductive power supply through the electromagnetic waves.

The detector chip 200 needs power to be operated, so the power supply unit 241 of the detector chip 200 may include a secondary battery (not shown), for storing the power required by the detector chip 200. The secondary battery may be the rechargeable secondary battery to extend the service life of the detector chip 200. However, in an embodiment of the disclosure, the secondary battery is a non-rechargeable micro-battery, for providing a limited service life to reduce the volume and the cost of the device. The user can determine to use the rechargeable secondary battery or the non-rechargeable micro-battery according to demands in application. In the case of adopting the rechargeable secondary battery, the power supply unit 241 may further include an inductive power generator (not shown), for receiving an external inductive power supply, for example, the electromagnetic waves sent by the information detection unit 110. The power supply unit 241 may further include a power supply converter (not shown), for converting the external power supplied through, for example, the USB cable or other power supply lines and the signal lines into the power required by the detector chip 200. But, in some of the functional elements that need to work for a long period of time, the self-contained power supply is needed. If necessary, a standby power supply may also be included.

The detector chip 200 may further include a clock unit 261. The clock unit 261 may include a clock signal generator and a synchronization circuit (both not shown), for performing synchronization with the information detection unit 100. The detector chip 200 may further include a timer 271, so that the processing device 251 can be triggered at predetermined time to transmit the detection signal to the portable information detection and processing device 100. The processing device 251 may also be configured to transmit the recorded information in the memory unit 221 to the portable information detection and processing device 100 through the communication unit 231 when receiving a request signal of the portable information detection and processing device 100. The elements may be commercially available elements, and the control manner of the elements is not limited. Different designs may be made by persons of ordinary skill in the art according to demands in application and in consideration of the cost.

In application, the information detection unit 110 transmits a signal to the functional elements 20, 30, 40 in the scanning manner to request the functional elements 20, 30, 40 for providing the recorded information, respectively. However, the information detection unit 110 may also be connected to the functional elements 20, 30, 40 in a manner of triggering the functional elements 20, 30, 40 at the same time, respectively. In this case, the information detection unit 110 may periodically transmit the request signal and obtain time-continuous or substantially continuous detection signals. As described above, the request signal generated by the information detection unit 110 may also serve as an inductive power supply of the specific functional elements 20, 30, 40, respectively. Additionally, the request signal may also include a clock signal serving as a synchronizing signal of the functional elements 20, 30, 40 for synchronous correction, respectively.

If one of the functional elements 20, 30, 40 is a detection device, a permanent operation mode, a timed operation mode, or an on-activation operation mode may be adopted, depending on demand in application. If the on-activation operation mode is adopted, one of the functional elements 20, 30, 40 may be generally activated by the portable information detection and processing device 100. In applications of specific use, especially in applications where one of the functional elements 20, 30, 40 includes a detector, one of the functional elements 20, 30, 40 may also be configured to be activated by a single environmental condition.

In an embodiment of the disclosure, the functional elements 20, 30, 40 corresponding to the portable information detection and processing device 100 are disposed in the same geographic area to detect and record the property of a specific target or changes in the property to generate recorded information. The size of the area is not limited, as the management is convenient and the demands in application involved in detection and communication can be met. Generally speaking, the size of the area does not need to be too large to prevent increase of the communication cost or unnecessary difficulties in signal processing and wiring, which, however, is not any technical limitation.

An application embodiment of the disclosure is that in a small-scale system, the portable information detection and processing device may include an information detection and processing device for ID recognition attached outside a gate of a space, for detecting an subject to be detected in the space. The system may be used in, for example, wards, offices, factories and military areas, where persons fitted with a wireless ID recognition chip such as an RFID exist in the detection space, and a list of the persons is displayed on a display unit. The system may also be used in, for example, veterinary hospitals, zoos and pet shops, for detecting animals in a specific space, where a list of animals is displayed on a display unit. The system may also be used in places such as garages, warehouses, drugstores and shops, for detecting items equipped with a wireless ID recognition chip in a specific space, and the types and the quantities of the items are displayed on an LCD of a display unit. An inspector can know the persons and animals existing or other items stored in the space without opening a door, a gate, a cabinet door or a drawer, read the information with a read device, and provide the information to, for example, an inventory management system for use.

In another small-scale system, the portable information detection and processing device may detect functional elements with different functions. The embodiment includes fitting the portable information detection and processing device on a patient's body to detect an ID recognition wrist ring, a clinical thermometer, a displacement sensor, a hemadynamometer, a heart rate meter and a blood glucose meter on the patient's body. If the patient's body has other implanted chips such as a mini insulin injector therein, the portable information detection and processing device may also detect information such as a reading and a residual level, and the portable information detection and processing device may even activate the implanted chip. The reading or the recorded information detected by the portable information detection and processing device may be displayed on a display or expressed by a plotter for inspection and recording.

In some embodiments of the disclosure, a part or all of the functional elements are supplied with a wired or wireless power supply by the information detection and processing device, so the size of the functional element is reduced, which is convenient for installation and maintenance. The recorded information detected by the information detection and processing device not only can be displayed on the display unit, but also can be read by the read device and be supplied to other computer devices or analytical instruments for further use.

Figure 3:
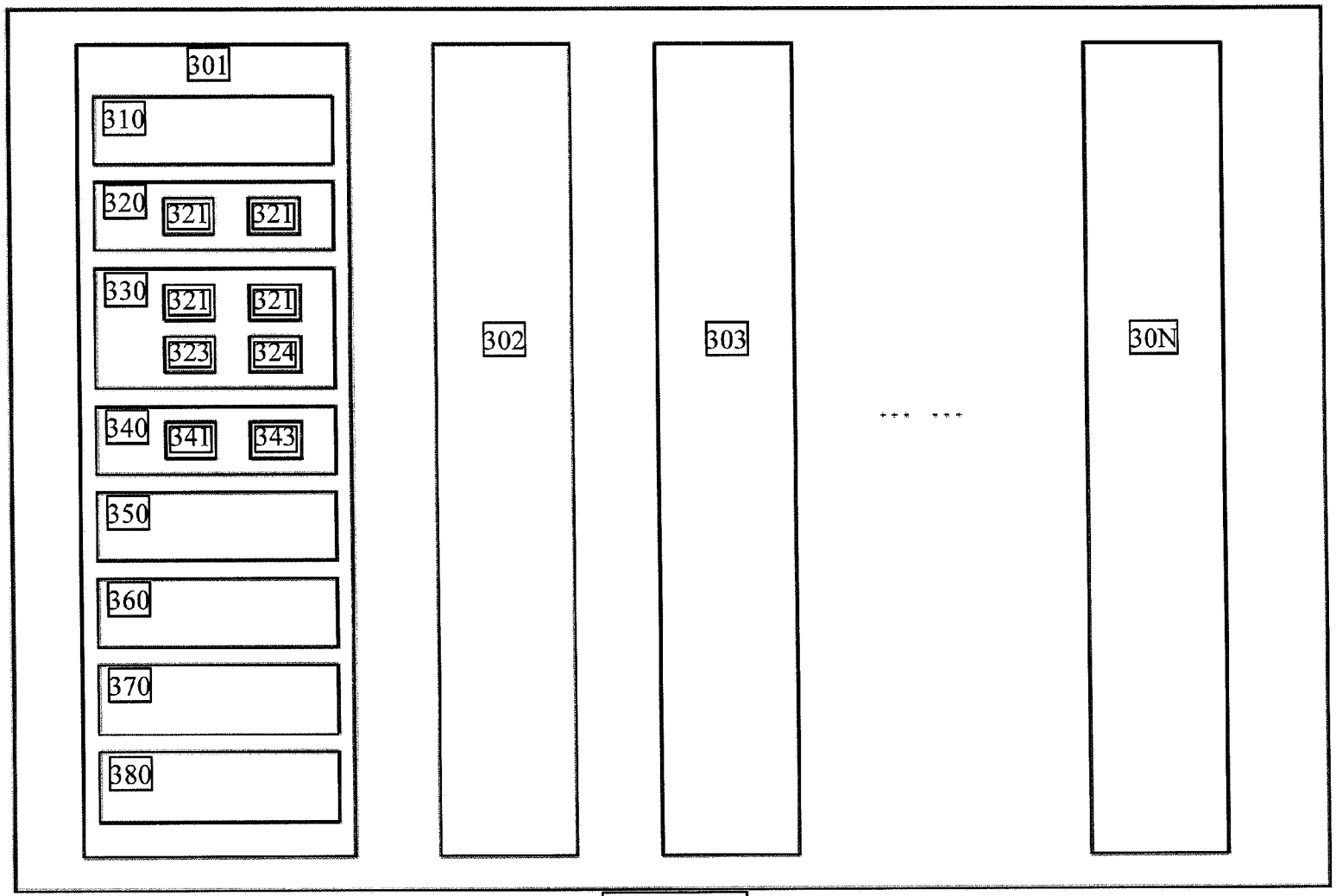
FIG. 3 is a systematic view of an embodiment of application of the disclosure in a factory security monitoring system.

In a large-scale system, an application embodiment of the disclosure is that multiple portable information detection and processing systems are combined to serve as a factory security monitoring system. FIG. 3 is a systematic view of an embodiment of application of the disclosure in a factory security monitoring system.

For example, a factory security monitoring system 300 may include several groups to hundreds of groups of portable information detection and processing systems 301, 302, 303, . . . and 30N, and each group of the portable information detection and processing systems includes one portable information detection and processing device and several functional elements. For example, the portable information detection and processing system 301 shown in the figure includes a portable information detection and processing device 310 and three groups of functional elements 320, 330, 340. The group of the functional elements 320 may include a group of security system detectors such as door and window shock sensors 321, 322, a photoelectric switch 323 and a fire sensor 324 disposed in a specific factory area such as a compartment in the factory area. The functional element 330 may include a group of gas leakage sensors, including a hygrometer 331 and chemical sensors 332, 333, 334. The functional element 340 may include a group of structure safety sensors, including a displacement sensor 341 and shock sensors 342, 343. All the three groups of functional elements 320, 330, 340 are connected to the same portable information detection and processing device 310 to form a connection relationship. Other portable information detection and processing systems also have the same or similar architecture and elements, and are disposed in other compartments in the factory area. The portable information detection and processing device of the portable information detection and processing systems 301, 302, 303, . . . and 30N, for example, the portable information detection and processing device 310, can periodically transmit a detection signal to the functional elements of the groups of functional elements 320, 330 and 340 to read the information recorded by the functional elements and display the information on the display unit, for example, a display device 350, and record the information in a recording unit, for example, a recording unit 360.

In inspection, an inspector can generally read content displayed by the portable information detection and processing device visually, capture the information with a read device (not shown), and provide the information to a relevant computer apparatus for use. The computer apparatus may be any apparatus having the operation capability, for example, a local or remote server, a computer, a laptop computer, an information processing device, a control device and a communication device.

According to the design of the disclosure, any one of the portable information detection and processing devices such as the portable information detection and processing device 310 may be configured to determine the detector which transmitted a signal when receiving a detection signal sent by any detector among the security system detectors 320 and perform operation according to predetermined calculation and/or inference rules, and determine whether the value of the recorded information transmitted by the detector reaches a level that a communication unit 370 or an alarm unit 380 needs to be activated. For example, when the detection signal is transmitted by the door and window shock sensor 321 and the value of the shock exceeds a threshold, it is determined that the communication unit 370 or the alarm unit 380 needs to be activated. At this time, the information detection and processing device 310 automatically activates the communication unit 370, and transmits the detector code, the value of the recorded information and the determination to the factory security monitoring system 300 through the communication unit 370. After receiving the detection signal, the factory security monitoring system 300 manually or automatically determines that a risk of intrusion possibly exists in the area, so the factory security monitoring system 300 manually or automatically notifies an inspector to inspect the area. If the value reaches the level that the alarm unit 380 needs to be activated, the information detection and processing device 310 automatically activates the alarm unit 380 to generate alarm signals such as a buzz and a flashing light to deter the intruder.

The local detection and processing system of the disclosure may collect and display information recorded by the different types of the functional elements in the specific space, in which the information includes ID recognition information recorded by the functional element and the physical, chemical or biological information and changes detected by the functional element. Moreover, the system may perform processing on the detected information in the predetermined manner according to the detection purpose and property of the detected information when it is determined that the information needs to be transmitted. The information obtained in detection may be visually inspected, and may also be collected by a relevant apparatus for further use. In this way, the personnel and item management in the specific space and the security management and control of the specific space can be simplified; moreover, the modularization capability, flexibility and scalability of the system can be improved.

What is claimed is:

1. A portable information detection and processing device, comprising:

an information detection unit, for acquiring information recorded by at least one functional element;

a memory unit, for storing recognition data of the at least one functional element and the information acquired by the information detection unit;

a display unit, for displaying the recognition data of the functional element and the information acquired by the information detection unit; and an information processing unit, connected to the information detection unit, the memory unit and the display unit, for processing the recognition data of the functional element and the information acquired by the information detection unit, to control the information detection unit, the memory unit and the display unit, wherein the information processing unit performs an operation on a value of the information acquired by the information detection unit to generate an operation result, and when the operation result exceeds a threshold, the information processing unit generates an activation signal to activate the display unit to display the operation result on the display unit.

2. The portable information detection and processing device according to claim 1, wherein the information detection unit transmits a wake-up signal to the at least one functional element to activate the functional element.

3. The portable information detection and processing device according to claim 2, wherein the information processing unit is configured to control the information detection unit to periodically transmit the wake-up signal to the functional element.

4. The portable information detection and processing device according to claim 2, wherein the information processing unit is configured to control the information detection unit to transmit the wake-up signal to the functional element in a certain order.

5. The portable information detection and processing device according to claim 1, wherein the information processing unit is configured to control the information detection unit to periodically acquire the information recorded by the at least one functional element.

6. The portable information detection and processing device according to claim 1, wherein the information processing unit is configured to control the information detection unit to acquire the information recorded by the at least one functional element in a certain order.

7. The portable information detection and processing device according to claim 1, wherein the information processing unit is configured to control the display unit to periodically display the information.

8. The portable information detection and processing device according to claim 1, wherein the information processing unit is configured to control the display unit to display the information in a certain order.

9. The portable information detection and processing device according to claim 1, further comprising a switch unit, for generating a wake-up signal in response to an external switch action to activate the information processing unit to activate the information detection unit and/or the display unit.

10. The portable information detection and processing device according to claim 9, wherein the switch unit is a manual switch, a photoelectric switch or a sensor switch.

11. The portable information detection and processing device according to claim 1, further comprising an alarm device, wherein the information processing unit is capable of generating an activation signal to activate the alarm device, when a value of an operation result of the recorded information detected by the functional element exceeds a threshold.

12. The portable information detection and processing device according to claim 1, wherein the alarm device is a buzzer, an alarm lamp or a loudspeaker.

13. The portable information detection and processing device according to claim 1, further comprising a communication unit, for transmitting specific information to an external machine in response to an activation signal, wherein the specific information comprises the recognition data of the functional element and the information detected by the functional element.

14. The portable information detection and processing device according to claim 13, wherein the information processing unit is capable of performing operation on a value of a received detection signal to generate an operation result, and generating the activation signal when the operation result exceeds a threshold to transfer the operation result to the external machine through the communication unit.

15. The portable information detection and processing device according to claim 1, wherein the memory unit is capable of recording a code of the functional element, the information detected by the functional element, and a detection time.

16. The portable information detection and processing device according to claim 15, wherein the information processing unit is capable of activating a communication unit when receiving a wake-up signal to transfer the information stored by the memory unit to an external machine.

17. A portable information detection and processing system, comprising a portable information detection and processing device according to any one of claim 1 and at least one functional element, wherein the portable information detection and processing device is capable of acquiring the information recorded by the functional element and displaying the information on the display unit.

18. The portable information detection and processing system according to claim 17, wherein the functional element is at least one detector selected from a pressure sensor, a gravity sensor, a sound sensor, an optical sensor, a humidity sensor, a temperature sensor, a displacement sensor, a shock sensor, a gas sensor, a chemical sensor and a satellite localizer.

19. The portable information detection and processing system according to claim 17, wherein the functional element is an identity (ID) recognition chip.

20. The portable information detection and processing system according to claim 17, wherein the functional element further comprises a power supply unit, for managing power required by the functional element.

21. The portable information detection and processing system according to claim 20, wherein the power supply unit comprises a converter, for converting an external power into the power required by the functional element.

22. The portable information detection and processing system according to claim 21, wherein the external power comprises another power supplied by an external wireless energy source.

23. The portable information detection and processing system according to claim 22, wherein the external wireless energy source comprises an inductive energy source, and the power supply unit comprises an inductive power generator.

24. The portable information detection and processing system according to claim 20, wherein the wake-up signal transmitted by the information detection unit has specific power, and the power supply unit of the functional element is equipped with a mechanism for receiving the specific power and converting the specific power into a working voltage.

25. The portable information detection and processing system according to claim 21, wherein the functional element is further equipped with a rechargeable secondary battery for storing the power.

26. The portable information detection and processing system according to claim 17, wherein the portable information detection and processing device is capable of displaying the recorded information obtained in detection on the display unit when a specific condition is satisfied.

27. The portable information detection and processing system according to claim 17, wherein the portable information detection and processing device is capable of displaying the recorded information obtained in detection on the display unit when receiving the wake-up signal.

28. The portable information detection and processing system according to claim 17, wherein the portable information detection and processing device further comprises a communication unit for transmitting the recorded information obtained in detection when a specific condition is satisfied.

* * * * *